US005539275A

United States Patent [19]

Arimoto et al.

[11] Patent Number: 5,539,275

[45] Date of Patent: Jul. 23, 1996

[54] DISPLAY DEVICE AND A METHOD FOR PRODUCING THE SAME

[75] Inventors: Nozomu Arimoto, Takatsuki; Hidekazu Hayama, Moriguchi; Toshihide Takahashi, Takatsuki; Hitoaki Tohda, Osaka, all of Japan

[73] Assignee: Matsushita Electric Corporation, Kadoma, Japan

[21] Appl. No.: 41,597

[22] Filed: Apr. 5, 1993

[30] Foreign Application Priority Data

Apr. 6, 1992 [JP] Japan ..... 4-083551
Jul. 24, 1992 [JP] Japan ..... 4-198161

[51] Int. Cl.[6] ..... H01J 29/10
[52] U.S. Cl. ..... 313/461; 313/473
[58] Field of Search ..... 313/461, 473; 428/216, 426

[56] References Cited

U.S. PATENT DOCUMENTS 4,563,612 1/1986 Deal et al. .
4,847,157 7/1989 Goodman et al. ..... 428/426
4,945,282 7/1990 Kawamura et al. .
5,091,244 2/1992 Biornard ..... 428/216

FOREIGN PATENT DOCUMENTS 131341 1/1985 European Pat. Off. .
263541 4/1988 European Pat. Off. .
372488 6/1990 European Pat. Off. .
0468423 7/1991 European Pat. Off. .
59-50401 3/1984 Japan .
3-78946 4/1991 Japan .
404098742 3/1992 Japan ..... 313/461

OTHER PUBLICATIONS

Patent Abstract of Japan, vol. 14 No. 252 (E-934(4195) May 1990 re JP-A 02072549.

Kawamura e al, "Combined Antistatic and Antireflection Coating for CRT's", Sid International Symposium: Digest of Technical Papers, 1989, pp. 270–273.

*Primary Examiner*—Sandra L. O'Shea
*Assistant Examiner*—Vip Patel
*Attorney, Agent, or Firm*—Cushman, Darby & Cushman

[57] ABSTRACT

On the outer surface of the glass face panel 2 of a display device, a first layer 5 of an electrically conductive transparent thin film, a second layer 6 of another transparent thin film consisting essentially of silicon dioxide ($SiO_2$) or magnesium fluoride ($MgF_2$), and a third layer 7 of uneven exposed surface, are deposited, whereby a multiplicity of concave regions of said third layer 7 form an interference film together with said first 5 and second layer 6, whereas a multiplicity of convex regions of said third layer form an irregular reflection surface.

4 Claims, 3 Drawing Sheets

DISPLAY DEVICE AND A METHOD FOR PRODUCING THE SAME

FIELD OF THE INVENTION AND RELATED ART STATEMENT

1. Field of the Invention

The present invention generally relates to a display device and a method for producing such display device. In particular, the present invention is concerned with the display device, such as a cathode ray tube (CRT) or a plasma display panel, having a face panel which has both functions of anti-static charging and reduced reflection.

2. Description of the Prior Art

When an outer light from the room lamp and the like impinges on and is reflected from an outer surface of the glass face panel of the display device such as the CRT, an image produced on the screen of the display device becomes to be illegible. When a charge is accumulated on the outer surface of the face panel, it becomes liable to attract dust particles hence to make the image obscure and besides induce the hazard of an electric shock.

In order to cope with such circumstances, it has been a conventional practice to roughen the outer surface of the face panel by a chemical or mechanical means and render the outer surface to perform an irregular reflection of the outer light. Another conventional measure is to deposit an electrically-conductive thin film composed of stannic oxide ($SnO_2$) or the like, on the outer surface of the face panel to make it anti-static charging.

The above-mentioned reflection reducing means can prevent the undesirable reflection of the outer light of the face panel by the provision of a multiplicity of the minute convex and concave spots of the outer surface of the face panel. The means however have a disadvantage such that the light emitted from light emission means for producing the display is also reflected irregularly on the toughened surface, thereby deteriorating the resolution of the display device and the glossiness of the face panel is also lost.

OBJECT AND SUMMARY OF THE INVENTION

It is therefore the primary object of the present invention to provide a display device that can overcome the above-mentioned disadvantages inherent to the prior art devices.

It is another object of the present invention to provide a method for producing the above-mentioned display device.

According to one aspect of the present invention, there is provided a display device comprising:

a glass face panel;

a first layer of an electrically-conductive transparent thin film, deposited on an outer surface of the glass face panel;

a second layer of another transparent thin film deposited on the first layer; and a third layer deposited on the second layer; wherein a large number of concave regions of in the third layer form an interference film together with the first and second layer and wherein a large number of convex regions of the third layer form an irregular reflection surface.

In the above-mentioned display device, the electrically-conductive thin film comprises; at least one number selected from the group consisting of stannic oxide ($SnO_2$, indium sesquioxide ($In_2O_3$), titanium dioxide ($TiO_2$) and zirconium dioxide ($ZrO_2$), or of a mixture of these compounds with silicon dioxide ($SiO_2$).

The third layer of uneven exposed surface is composed essentially of silicon dioxide ($SiO_2$) or magnesium fluoride ($MgF_2$).

According to another aspect of the present invention, there is provided a method for producing a display device which has a glass face panel, comprising:

depositing a first layer of an electrically conductive transparent thin film on an outer surface of the glass face panel by means of a spin-coating, a chemical vapor deposition (CVD), a dip-coating or spray coating;

depositing a second layer of transparent thin film consisting essentially of silicon dioxide ($SiO_2$) or magnesium fluoride ($MgF_2$), on the first layer of electrically conductive transparent thin film by means of spin-coating, a dip-coating or spray coating; and depositing a third layer of irregular reflection film on the second layer by means of spray coating.

By configuring the face panel of the display device as previously described, an anti-static effect can be obtained by the electrically- conductive transparent thin film and a remarkable anti-dazzling effect can also be obtained by the interference film and the irregular reflection film. Adequately selected irregular reflection does not deteriorate the required resolution of the displayed image, and maintains a moderate glossiness of the face panel. Further, since the irregular reflection layer has a multiplicity of the fine concave and convex spots or regions on its surface, there is another advantage in that no stain such as finger print is adhered to the outer surface of the face panel.

While the novel features of the present invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENTS

In the following paragraphs, the present invention will be described in more detail with reference to the preferred embodiments shown in the attached drawings.

Figure 2:
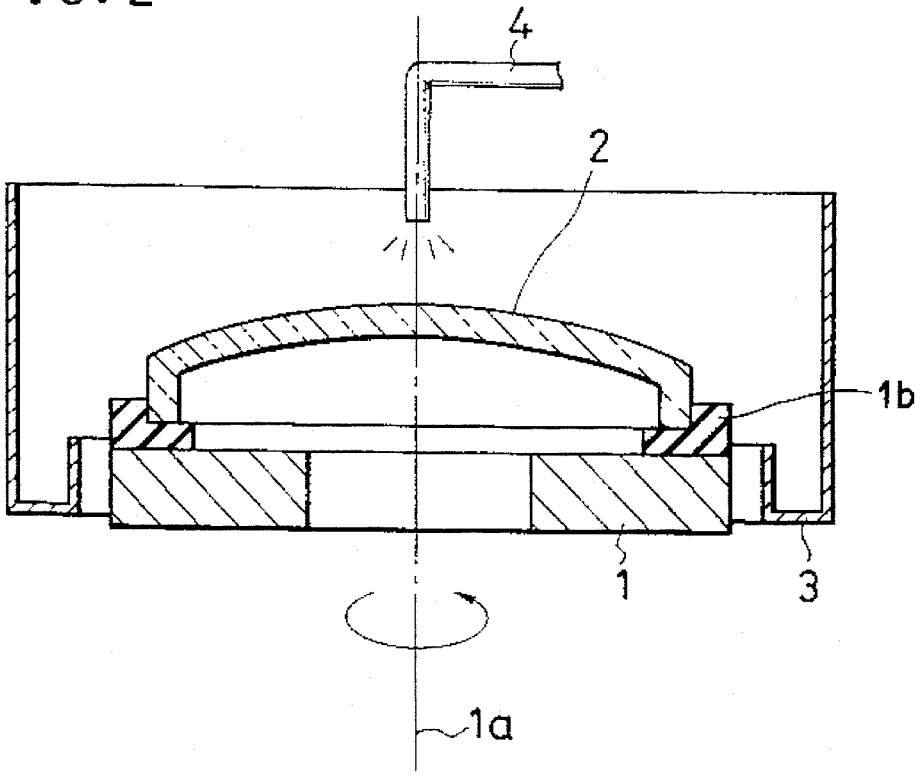
FIG. 2 is a side cross-sectional view illustrating the spin-coating process, as a step of the production method in accordance with the present invention.

In FIG.2, the face panel 2 is one for a 17 inch type color cathode ray tube and is mounted, through a rubber cushion 1*b*, on a rotating table 1 which is enclosed in a painting booth 3 equipped with a nozzle 4 for injecting a solution for deposition. The outer surface of the face panel 2 has already been finished by polishing with a buffing tool impregnated with a grinding agent such as cerium dioxide washing with deionized water, drying as well as air blowing for removing the dust.

The rotating table 1 is permitted to rotate around an axis 1*a* together with the face panel 2 at a rate of revolution of approximately 100 rpm. A volatile solution containing stannic oxide and silica is applied on the center of the outer surface of the face panel 2 by dripping through the nozzle 4 for injecting the solution, rotating the face panel and keeping its outer surface at a temperature of about 40° C. The solution supplied by dripping on the above-mentioned outer surface extends from its center to its periphery by the rotation, which is continued for about 30 seconds, whereby an uniform film of the solution is formed by the spin-coating.

At the end of this step, the above-mentioned dripping is stopped but the rotation is still continued for about 80 second at a halved rate, i.e., about 50 rpm. During this rotation, the film forming material in the solution is dried by maintaining the temperature of the outer surface of the face panel 2 at a temperature of about 50° C. with a planer heater, infrared lamp or the like means. It is convenient for preventing the mixing of the film forming material with that of a second layer, which will be described later. The employed volatile solution is obtained by dissolving a polymer of an alkyl silicate and fine powder of stannic oxide ($SnO_2$) in an alcoholic solvent.

Figure 1:
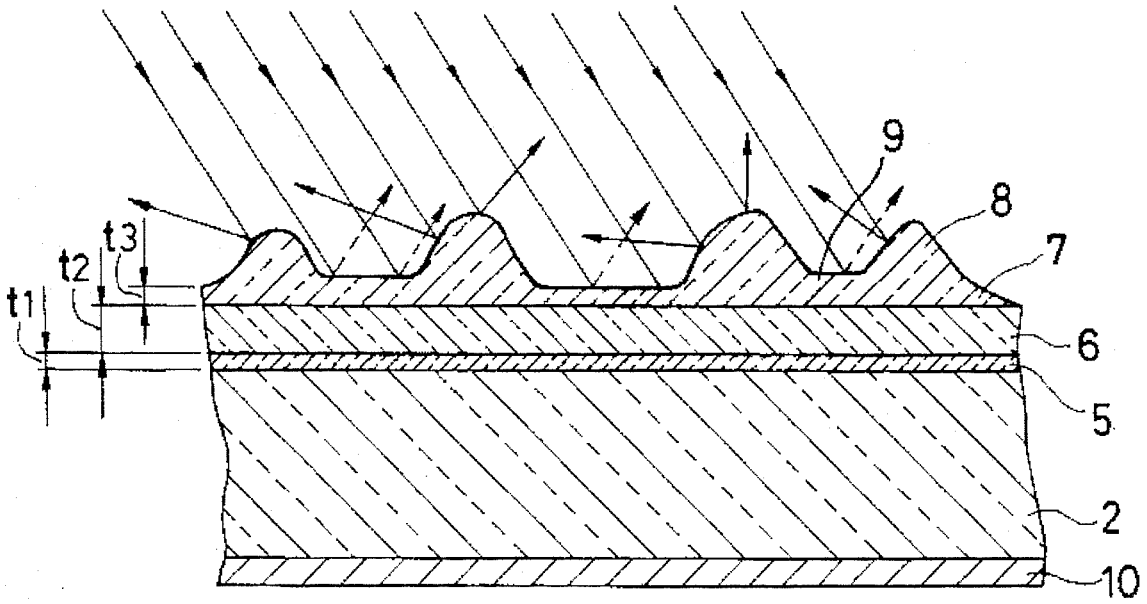
FIG. 1 is a cross-sectional view of an essential part of the face panel of the display device built in accordance with an embodiment of the present invention.

In the above-mentioned manner, the first layer 5 of the thickness $t_1$ of about 80 nm having a high refractive index ($n_1$) is formed on the outer surface of the face panel 2 as shown by FIG. 1. Next, in order to give a low reflecting function to the face panel 1, the second layer 6 having a low refractive index ($n_2$) is formed on the surface of the first layer 5. As the film forming material for the second layer 6, one obtained by dissolving only the alkyl silicate polymer is employed; and thereon, another film of an uniform thickness $t_2$ of about 70 nm is formed by the spin-coating; and the drying is made as mentioned in the above. Although the employed conditions for the deposition of the second layer 6 are similar to those employed in forming the first layer 5, the temperature kept during the drying, as the final step, is set at 60°–80° C. Besides the material to make $SiO_2$, a material to form $MgF_2$ may similarly be used.

Then, the face panel 2 dismounted from the rotating table 1 is transferred to a spray coating process, and a third layer 7 is formed on the surface of the second layer 6 by known spray coating. And the coated film is finished by heating at 400°–450° C. for about 20 min. By this heat treatment, the first layer 5, the second layer 6 and the third layer 7 are all baked firmly on the surface of the face panel 2.

The third layer 7 has a fine crater-like uneven configuration on its exposed surface; and its concave regions 9 whereat the average thickness is $t_3$ constitute an interference film together with the second layer 6 as well as the first layer 5. On the other hand, the convex regions 8 around the crater-like concave regions 9 reflect the outer light irregularly. Preferable range of the thickness $t_3$ is between 5 nm and 60 nm. This will be discussed later. The outer light impinging on the concave regions 9 is reflected with reduced intensity resulting from the interference as shown by the dotted arrow in FIG. 1, while the light impinging on the convex regions 8 is reflected irregularly. In FIG. 1, there is also shown a film 10 of a fluorescent material provided on the inner side of the face panel.

Figure 3:
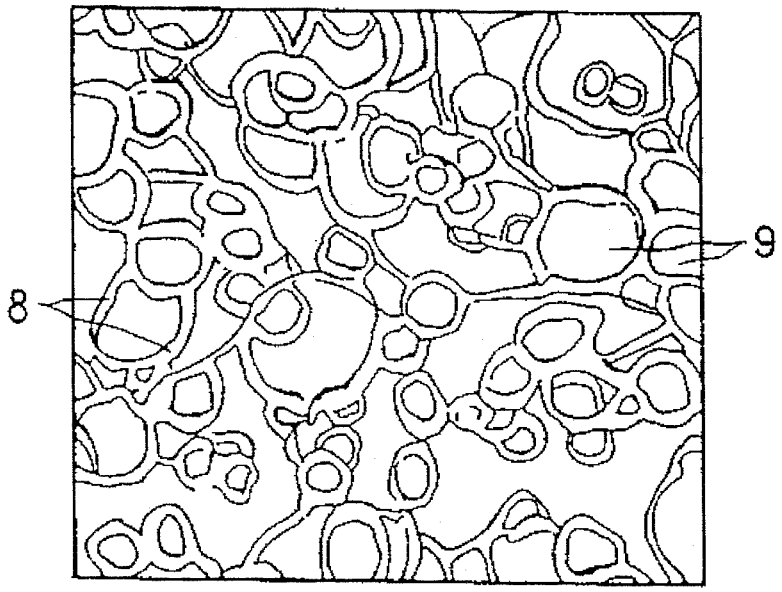
FIG. 3 is an enlarged plan view of the exposed surface of the face panel of the display device built in accordance with the present invention.

FIG. 3 is an enlarged plan view of the crater-like uneven surface configuration (glossiness: 75), wherein there are the convex regions 8 surrounding the concave regions 9. When each of the convex regions 8 is connected to others, and each area of surrounded by the convex regions is reduced, the glossiness is reduced. In case of such low glossiness, the irregular reflection is relatively high, while the effect of reduction of the undesirable reflection by the optical interference decreases. A preferable result is obtainable for the glossinesses in a range of 65–85.

The above-mentioned interference film reduces the reflection of the lights of room lighting by fluorescent lamp, outside light from the window and the like; and the above-mentioned convex regions reflect these lights irregularly. The surface electric resistance of this film is 1 KΩ–1 MΩ/square, and this value is sufficient for performing the anti-static function. Furthermore, the above-mentioned interference film is grounded through a periphery guard metal band surrounding the outer periphery of the face panel 2.

Provided that film thicknesses of the first layer, the second layer and the third layer are $t_1$, $t_2$ and $t_3$, respectively, wavelength of the outer light is $\lambda$ and refractive index of the face panel is $n_g$; then an ideal condition to make the reflection light zero is obtainable by fulfilling the following equations:

$$n_1 \cdot t_1 = \frac{\lambda}{4}$$

and $$n_2 \cdot (t_2 + t_3) = \frac{\lambda}{4},$$

where the following relation holds concerning the surface reflectance R of the face panel:

$$R = \left( \frac{n_2^2 \cdot n_g - n_1^2}{n_2^2 \cdot n_g + n_1^2} \right)^2 = 0.$$

Therefore, it is required to satisfy the following formula:

$$\frac{n_1}{n_2} = \sqrt{n_g}.$$

In an actual case, wherein $n_g$= 1.54, $n_1$=1.82 and $n_2$=1.47, the value of R is obtained as $R=5.3\times10^{-6}$ (%); and thus the reflectance R at the outer surface of the face panel becomes approximately zero. In order to make the reflectance close to zero for the light of the wavelength of 555 nm at which the CIE standard photopic luminous efficiency becomes maximum, a condition becomes $t_1$=76nm, $t_2+t_3$=94, because $n_1 \cdot t_1=\lambda/4$ and $n_2$ $(t_2+t_3)=\lambda/4$. Since the average thickness $t_3$ of the concave regions 9 of the third layer is about 20 nm, when the thickness $t_1$ of the first layer 5 is set to 76 nm and the thickness $t_2$ of the second layer 6 is set to 74 nm, a value of the reflectance of the surface becomes close to zero.

In the foregoing embodiment, the first layer is formed by the spin-coating with the film forming material of the volatile solution containing both the stannic oxide and silica, but the first layer may alternatively be a layer containing only stannic oxide ($SnO_2$). The film forming material employed for the first layer may be at least one member selected from stannic oxide ($SnO_2$), indium sesquioxide ($In_2O_3$), titanium dioxide ($TiO_2$) and zirconium dioxide ($ZrO_2$), or a mixture of these compounds with silicon dioxide ($SiO_2$); and the first layer may be deposited by means of the chemical vapor deposition (CVD) instead of the spin coating, In case of forming the first layer from $SnO_2$, the thicknesses of the respective layers to make the surface reflectance R zero is obtained by a different ideal condition from that of the foregoing case. In this different condition, the surface reflectance R for the refractive index $n_g$ of the face panel is given by the following formula:

$$R = \frac{X}{1+X}$$

where, X is represented by the following formula:

$$X = 0.385 \left\{ \left[ \left( \frac{n_2}{n_1} - 0.649 \frac{n_1}{n_2} \right) \sin g_1 \cdot \sin g_2 - 0.351 \cos g_1 \cos g_2 \right]^2 + \left[ \left( \frac{1}{n_2} - \frac{n_2}{1.54} \right) \cos g_1 \cdot \sin g_2 + \left( \frac{1}{n_1} - \frac{n_1}{1.54} \right) \sin g_1 \cos g_2 \right]^2 \right\}$$

where, $g_1$ and $g_2$ are represented by the following formulae:

$$g_1 = \frac{2\pi}{\lambda} n_1 t_1,\ g_2 = \frac{2\pi}{\lambda} n_2 (t_2 + t_3).$$

And, by rearranging the above formulae by substituting as X=0 for R=0, the conditions represented by the following formulae are obtained:

$$\tan^2 g_1 = n_1^2 \frac{(-0.54) \times (1.54 - n_2^2)}{(1.54\, n_2^2 - n_1^2)(1.54 - n_1^2)}$$

$$\tan^2 g_2 = n_2^2 \frac{(-0.54) \times (1.54 - n_1^2)}{(1.54\, n_2^2 - n_1^2)(1.54 - n_2^2)}.$$

The conditions for R=0 in the case of $n_1$=2.0 and $n_2$=1.47 are $\tan^2 g_1$=0.81, $\tan^2 g_2$=6.87, $n_1 \cdot t_1$=64 nm and $n_2(t_2+t_3)$=170 nm.

From these, the following values are obtained:

$t_1$=32 nm , $t_2+t_3$=116 nm, $t_2$=96 nm and $t_3$=20 nm.

Figure 4:
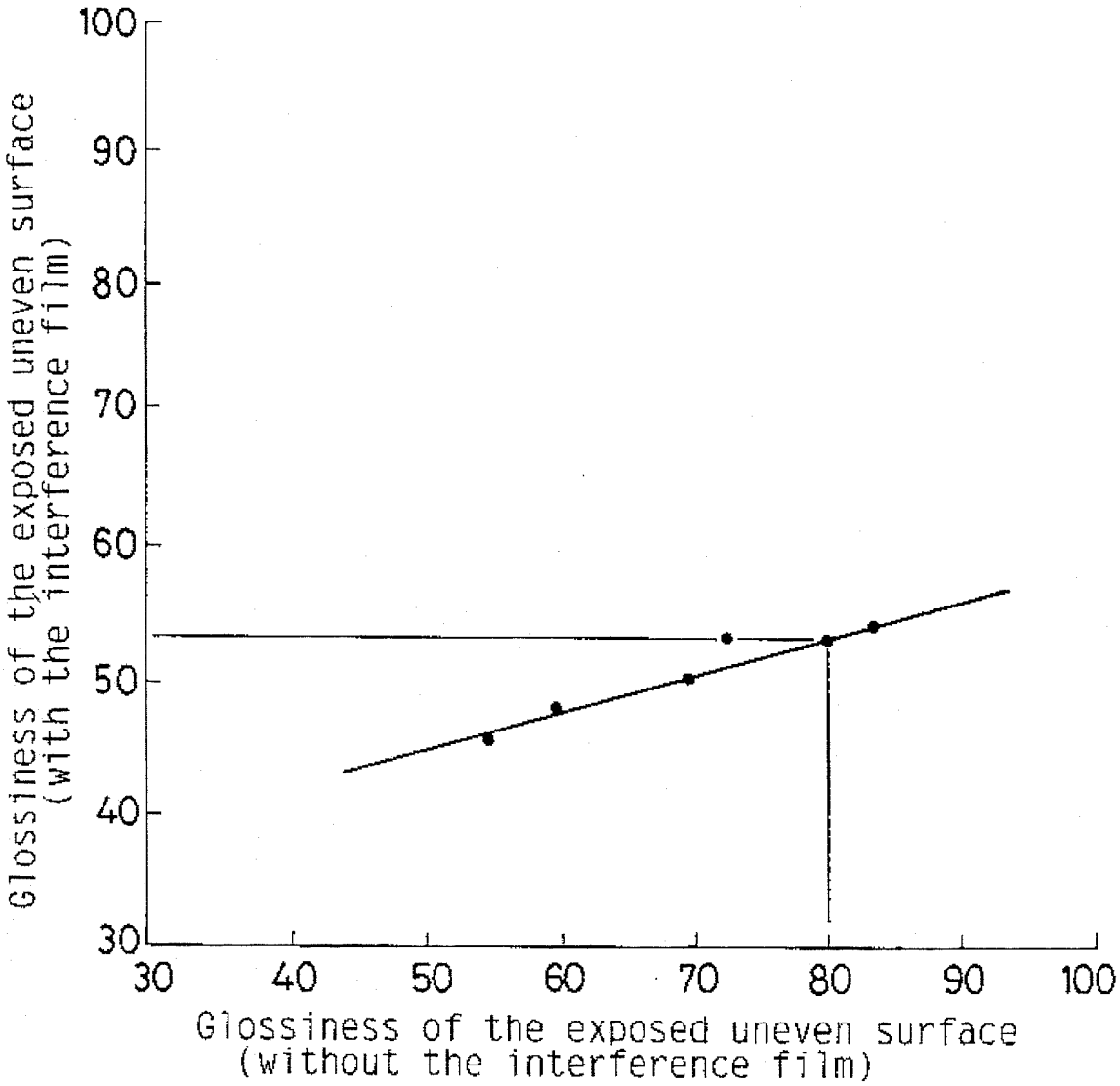
FIG. 4 is a view for illustrating the optical characteristics of the display device built in accordance with the present invention.

Referring now to FIG. 4, dots show a result of the glossiness measurement for the crater-like uneven exposed surfaces. The measurement is made by employing a mirror-finished surface specular glossiness measurement apparatus in accordance with JIS Z 8741 (Japanese Industrial Standard No. Z 8741). During this measurement, the incident angle of the light to the surface of the sample is fixed to 60 degree. For better understanding of the effect of the crater-like uneven exposed surface of the third layer deposited on the interference film, the measurements are made for both the layers with and without the interference film. And the correlation between the layers with the interference films and the layers without the same is shown in the figure.

As clearly shown by this measurement, the glossiness 80 of the surface without the interference film corresponds to the glossiness 53 of the surface with the interference film; and the difference 27 between them represents the reflection reducing effect.

In the foregoing embodiment, the first layer is formed by the spin-coating with the film forming material of the volatile solution containing stannic oxide and silica though, the first layer may alternatively be a layer containing only stannic oxide ($SnO_2$). Further, although the second layer 6 and the third layer 7 are formed by employing a solution obtained by dissolving a polymer of alkyl silicates in an alcoholic solvent, at least one of the second layer 6 and the third layer 7 may alternatively be formed by employing a mixture obtained by dissolving or dispersing at least one of the polymer of alkyl silicates and fine powder of magnesium fluoride ($MgF_2$) in the alcoholic solvent. For $MgF_2$ having the refractive index of 1.38, apart from the value 1.4 of $SiO_2$, the effect and advantage similar to these of the foregoing embodiments can also be-obtained in this case.

Although the present invention has been described in its preferred form with a certain degree of particularity, it is understood that the present disclosure of the preferred form has been changed in the details of construction and the combination and arrangement of parts and components may be resorted to without going out from the spirit and the scope of the invention as hereinafter claimed.

What is claimed is:

1. A display device comprising:

a glass face panel;

a first layer of an electrically-conductive transparent thin film which is deposited on an outer surface of said glass face panel;

a second layer of a second transparent thin film, which is deposited on said first layer and which has a lower refractive index than said first layer; and a third layer, which:

has a lower refractive index then said first layer, has a thickness between 5 mm to 60 mm, and is deposited on said second layer so that said third layer has a glossiness in a range from 65 to 85 as measured by a mirror-finished surface specular glossiness measurement apparatus in a condition that an incident angle of light to a surface is fixed to 60 degrees, wherein said third layer comprises a plurality of crater-like concave regions and convex regions, wherein a large number of said plurality of crater-like concave regions have flat faces which form an interference film together with said first and second layers, and a large number of said plurality of convex regions are ridge shaped so as to form an irregular reflection surface, which diminishes a reflective property of said third layer.

2. The display device according to claim 1, wherein said electrically-conductive thin film comprises at least one member selected from the group consisting of stannic oxide ($SnO_2$), indium sesquioxide ($In_2O_3$), titanium dioxide ($TiO_2$) and zirconium dioxide ($ZrO_2$), or of a mixture that includes stannic oxide ($SnO_2$), indium sesquioxide ($In_2O_3$), titanium dioxide ($TiO_2$) or zirconium dioxide ($ZrO_2$), and silicon dioxide ($SiO_2$).

3. The display device according to claim 1, wherein said third layer essentially of one of silicon dioxide ($SiO_2$) and magnesium has an average thickness that is thinner than said second layer.

4. A method for producing a display device which has a glass face panel, comprising:

depositing a first layer of an electrically conductive transparent thin film on an outer surface of said glass face panel by means of spin-coating, chemical vapor deposition (CVD), dip-coating or spray coating;

depositing a second layer of transparent thin film consisting essentially of silicon dioxide ($SiO_2$) or magnesium fluoride ($MgF_2$), on said first layer of electrically conductive transparent thin film by means of spin-coating, dip-coating or spray coating; and depositing a third layer of irregular reflection film consisting essentially of silicon dioxide ($SiO_2$) or magnesium fluoride ($MgF_2$), on said second layer by means of spray coating, including creating a plurality of crater-like concave regions and convex regions with flat faces on a large number of said plurality of crater-like concave regions for forming an interference film together with said first and second layers, and including shaping a large number of said plurality of convex regions as ridges for forming an irregular reflection surface which diminishes a reflective property of said third layer so that said third layer has a glossiness in a range from 65 to 85 as measured by a mirror-finished surface specular glossiness measurement apparatus in a condition that an incident angle of light to a surface is fixed to 60 degrees.

* * * * *

UNITED STATES PATENT AND TRADEMARK OFFICE

CERTIFICATE OF CORRECTION

PATENT NO. : 5,539,275

DATED : July 23, 1996

INVENTOR(S) : ARIMOTO et al

It is certified that error appears in the above-indentified patent and that said Letters Patent is hereby corrected as shown below:

On title page, change

"[73] Assignee: Matsushita Electric Corporation, Kadoma, Japan to

—[73] Assignee: Matsushita Electronics Corporation, Kadoma, Japan—

Signed and Sealed this

Seventeenth Day of June, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,539,275

DATED : July 23, 1996

INVENTOR(S) : ARIMOTO et al

It is certified that error appears in the above-identified patent and that said Letters Patent is hereby corrected as shown below:

Column 6, line 33 change "then" to —than—

Column 6, line 34 change " 5mm to 60mm " to —5nm to 60nm —

Signed and Sealed this

Thirtieth Day of December, 1997

Bruce Lehman

*Attest:*

BRUCE LEHMAN

*Attesting Officer*

*Commissioner of Patents and Trademarks*